US005381637A

United States Patent [19]

Farag

[11] Patent Number: 5,381,637

[45] Date of Patent: Jan. 17, 1995

[54] STOPLESS BUTT-JOINT CURTAINWALL SYSTEM

[76] Inventor: F. Aziz Farag, 43 N. Juliet St., Iselin, N.J. 08830

[21] Appl. No.: 170,971

[22] Filed: Dec. 21, 1993

Related U.S. Application Data

[63] Continuation of Ser. No. 869,765, Apr. 16, 1992, abandoned.

[51] Int. Cl.[6] ..... E04B 2/96; E04G 23/00

[52] U.S. Cl. ..... 52/204.595; 52/235; 52/747; 52/204.593; 52/204.597

[58] Field of Search ..... 52/235, 397, 398, 399, 52/400, 401, 302.1, 204.71, 204.52

[56] References Cited

U.S. PATENT DOCUMENTS

| | | | |
|---|---|---|---|
| 3,112,534 | 12/1963 | Winnan | 52/401 |
| 3,336,707 | 8/1967 | Horgan, Jr. | 52/400 |
| 3,672,107 | 6/1972 | Santry et al. . | |
| 3,734,550 | 5/1973 | Vance | 52/235 |
| 4,021,987 | 5/1977 | Schnebel et al. . | |
| 4,207,717 | 6/1980 | Hubbard | 52/235 |
| 4,500,572 | 2/1985 | Francis . | |
| 4,552,790 | 11/1985 | Francis . | |
| 4,625,481 | 12/1986 | Crandell . | |
| 4,633,631 | 1/1987 | Crandell | 52/399 |
| 4,650,702 | 3/1987 | Whitmyer | 52/398 |
| 4,686,805 | 8/1987 | Forslin . | |
| 4,724,637 | 2/1988 | Evans . | |
| 4,738,065 | 4/1988 | Crandell . | |
| 4,799,344 | 1/1989 | Francis . | |
| 4,803,817 | 2/1989 | White et al. . | |
| 4,809,475 | 3/1989 | Emmer | 52/235 |
| 4,815,245 | 3/1989 | Gartner . | |
| 4,817,351 | 4/1989 | Michlovic . | |
| 4,837,996 | 6/1989 | Eckelt . | |
| 4,841,700 | 6/1989 | Matthews . | |
| 4,905,435 | 3/1990 | Horst . | |
| 4,912,898 | 4/1990 | Holmes . | |
| 5,014,477 | 5/1991 | MacDonald | 52/235 |
| 5,094,051 | 3/1992 | Miller . | |
| 5,199,236 | 4/1993 | Allen . | |

*Primary Examiner*—Michael Safavi
*Attorney, Agent, or Firm*—Oliff & Berridge

[57] ABSTRACT

A system and method is employed to attach panels to vertical and horizontal mullions to form stopless butt-joint curtainwalls. A cap section of a panel engaging hook is attached to the edge of the panel, which typically comprises an insulated glass panel. The hook includes a flange leg portion which abuts a weather pressure gasket and is held in position by a channel shaped retainer clip. A retainer clip is attached to a portion of the mullion by means of a wedge. The a wedge is forced into the space between the retainer clip and the mullion through an aperture in the webb of retainer clip. A screw passes through another aperture in the retainer clip to further fasten the retainer clip to the mullions. The wedge in combination with a cushion located on the opposite side of the retainer clip from the wedge forms a thermal break. Once the assembly pieces are securely attached, the appropriate weather gasketing is provided between the retainer clip and the inside of the insulated glass panel. The panel could be single glazed, metal, granite or multiple or composite panels. Under such circumstances, the shape of the panel engaging hook will vary depending upon the nature of the panel to be engaged, whether the panel is integrally formed, edge attached or back attached.

32 Claims, 8 Drawing Sheets

STOPLESS BUTT-JOINT CURTAINWALL SYSTEM

This is a continuation of application Ser. No. 07/869,765 filed Apr. 16, 1992, now abandoned.

CROSS REFERENCE TO RELATED APPLICATIONS

The subject matter of this application is related to the subject matter of copending application Ser. No. 07/936,048, filed Aug. 26, 1992.

BACKGROUND OF THE INVENTION

1. Field of the Invention

The invention relates to an apparatus and method for forming stopless butt-joint curtain walls having thermal breaks therein.

2. Description of the Related Art

Modern buildings often have continuous facing panel areas extending around the building exterior. These panel areas can include panels of glass, metal, plastic, granite and the like. The panels can be supported by either direct or indirect attachment. In indirect attachment, a building's supporting framework is used to support non-bearing walls. These non-bearing exterior walls are referred to as curtainwalls. The problem of easily and permanently installing curtainwalls or replacing glass, facing panels or infills without: 1) exterior stops at the four sides of glass and other facing panels; 2) a thick front width of members known as the "sight line", which may show beyond the stopless glass; 3) glass secured with structural silicone sealant adhesion; 4) the use of an exterior scaffold for exterior application or access to joints; 5) use of extra metal and elements for providing extruded covers for inside the member structural element; 6) extensive field labor; 7) wet caulking weather seal field application; and 8) expensive integrated structural thermal breaks, has persisted in the curtainwall community, and these considerations are advantages of this present invention.

One conventional solution for providing a stopless glazing curtainwall is to provide a structural sealant between glass panels and metal members of supporting frame. U.S. Pat. No. 4,552,790 describes an approach for providing a unit that can be glazed without exterior stops or caps using structural sealant. Glass plates are joined with a spacer to seal the edges of the insulated glass panels. Structural sealant is used on two opposite sides of the spacer to bind the spacer to an adjacent inside surface of the glass plate. Application of the structural sealant is performed from the exterior of the building.

U.S. Pat. No. 4,724,637 describes an approach for interior installation of panels with a system for two sided vertical butt glaze. In this system, a factory glazed and assembled frame is insertable between head and sill liners from the building interior. The head and sill liners are visible from the exterior of the building. The glass panels are bonded to a portion of the frame by structural silicone. The use of structural silicone has the disadvantage of being a relatively expensive material. Further, the application of structural silicone to glass panels requires extensive labor, quality assurance and testing. Also, it is not clear how the glass panels would be replaced.

U.S. Pat. No. 4,912,898 describes an approach for providing a curtainwall having a smooth outer surface which is rail free. A curtainwall which is rail free requires butt joints having sufficient strength to hold the panels in place. This patent describes a butt joint which combines both an adhesive with a bracket to securely hold the panels in place. In this system access from outside the building is needed to install the panels.

U.S. Pat. No. 4,841,700 describes a narrow flush glazed framing system for curtainwalls including thermal breaks. A pair of vertical mullions define the outer boundaries of the framing system. Dual panels of glass are supported between the vertical mullions. A vertical intermediate mullion has a deep glazing channel and a slot for forming a shallow glazing channel. A thermal break is positioned in the deep glazing channel and a thermal break filler assembly fits into the slot to form the shallow glazing channel. The thermal break filler assembly includes a thermal break filler element snap fit between a pair of filler halves to form a three piece filler assembly. The thermal break filler assembly makes it possible to reduce the visible mullion face dimension without reducing the depth of the glazing channels of the mullion.

SUMMARY OF THE INVENTION

Briefly described, this present invention comprises a thermally broken curtainwall system, of four sided stopless butt-joint glazing or facing panels with dry gasket installation. All field labor for the initial installation or replacement of the curtainwall takes place from inside the building.

Panels of the curtainwall system are provided with a panel engaging hook shaped edge cap member. The hook shaped edge cap extends towards the interior of the building for abutting a weather pressure gasket of mullions. A retainer clip assembly holds the hook shaped edge cap against the weather pressure gasket. The retainer clip assembly includes a bracket channel retainer clip portion comprising webb and inner and outer flanges. An appropriately shaped cushion is positioned between the retainer clip and the mullion. The retainer clip and cushion is held in place by a wedge, possibly in combination with a screw. The cushion and wedge form a thermal break. The wedge has a tapered front. The hook shaped edge cap can be of varying shapes for engaging the different type panels. For example, the hook shaped edge cap of an insulated glass panel can be shaped to have one light recessed from the other, or shaped to have one light.

The thermal break material is arranged to be subject only to compression stress and it can be small cut pieces for cost savings. A thermal break may not be needed in the case of a controlled building environment on both sides of the curtainwall. Accordingly, in an alternative embodiment the curtainwall system is provided without a thermal break.

The panels can be glass, metal, granite/marble, insulation and the like of single, multiple or composite panels. The hook shaped edge cap can be field or factory installed, back attached, edge attached or integrally manufactured with the panels. The present invention has the advantages of allowing for panel thermal expansion and ease of manufacturing for erection tolerances and clearances. The invention may be more fully understood by reference to the following drawings.

DETAILED DESCRIPTION OF THE PREFERRED EMBODIMENT

During the course of the description like numbers will be used to identify like elements according to the different figures which illustrate the invention.

Figure 1:
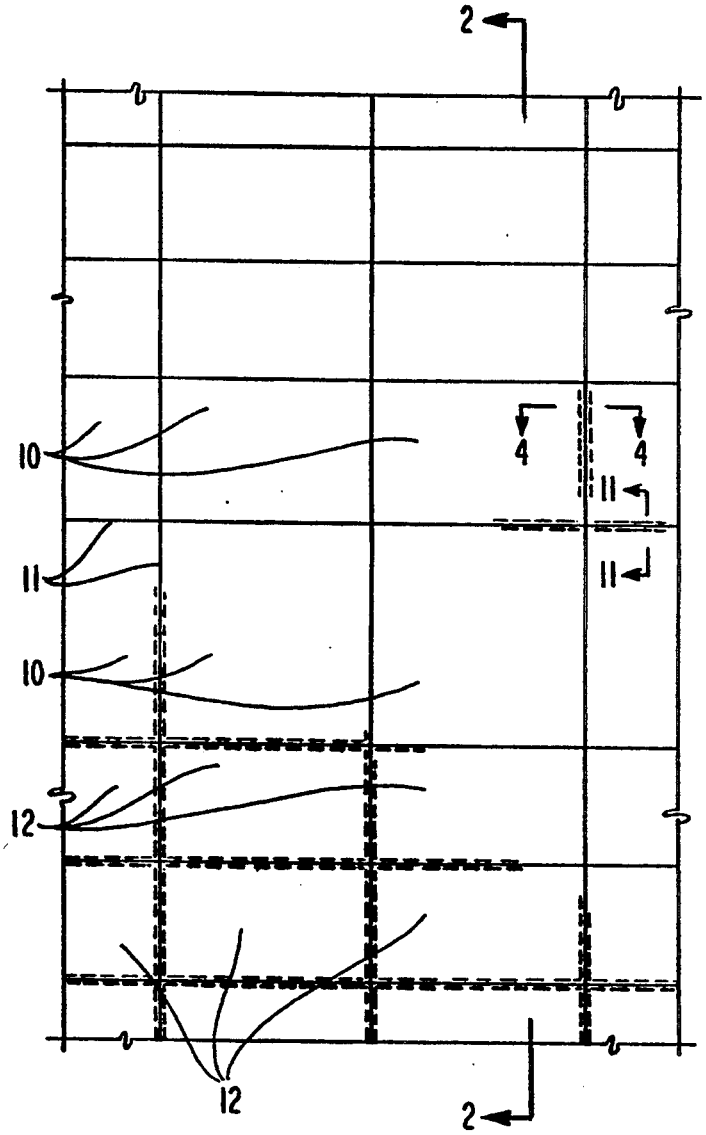
FIG. 1 is a front elevational view of the preferred embodiment of the invention.

FIG. 1 is a front elevational view of a curtainwall system constructed in accordance with the principals of the present invention. Insulated glass panels 10 are disposed in side by side relation to form rows of four sided stopless butt-joints 11. Spandrel glass panels 12 are arranged adjacent to one another to form rows of spandrel glass panels 12 between the rows of the insulated glass panel 10.

The curtainwall system of the present invention provides a minimum sight line of the vertical and horizontal mullions from the exterior of the building. The mullions are represented by dotted lines in FIG. 1. This viewed sight line is approximately 2.25 inches.

Figure 2:
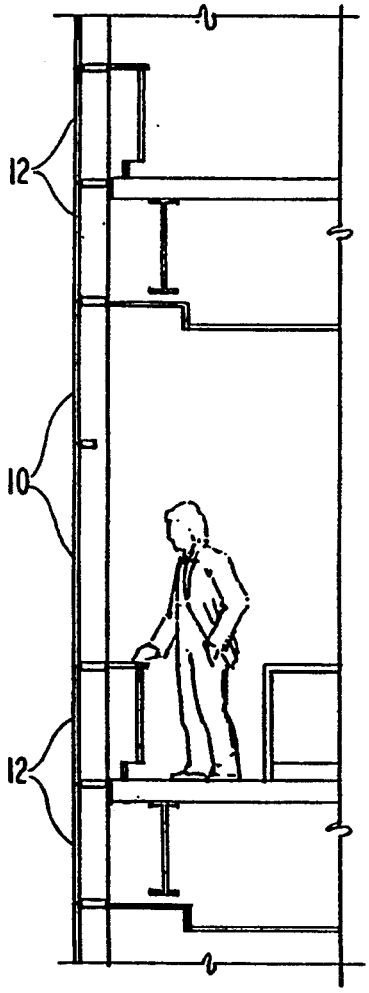
FIG. 2 is vertical cross-sectional view of the preferred embodiment of the invention.

In FIG. 2, a vertical cross-sectional view of a building with the curtain wall system is shown including insulated glass vision panels 10 located between spandrel glass panels 12. In alternate embodiments, spandrel blocked vision glass panels 12 may be replaced with panels of metal, plastic, granite and the like.

Figure 3:
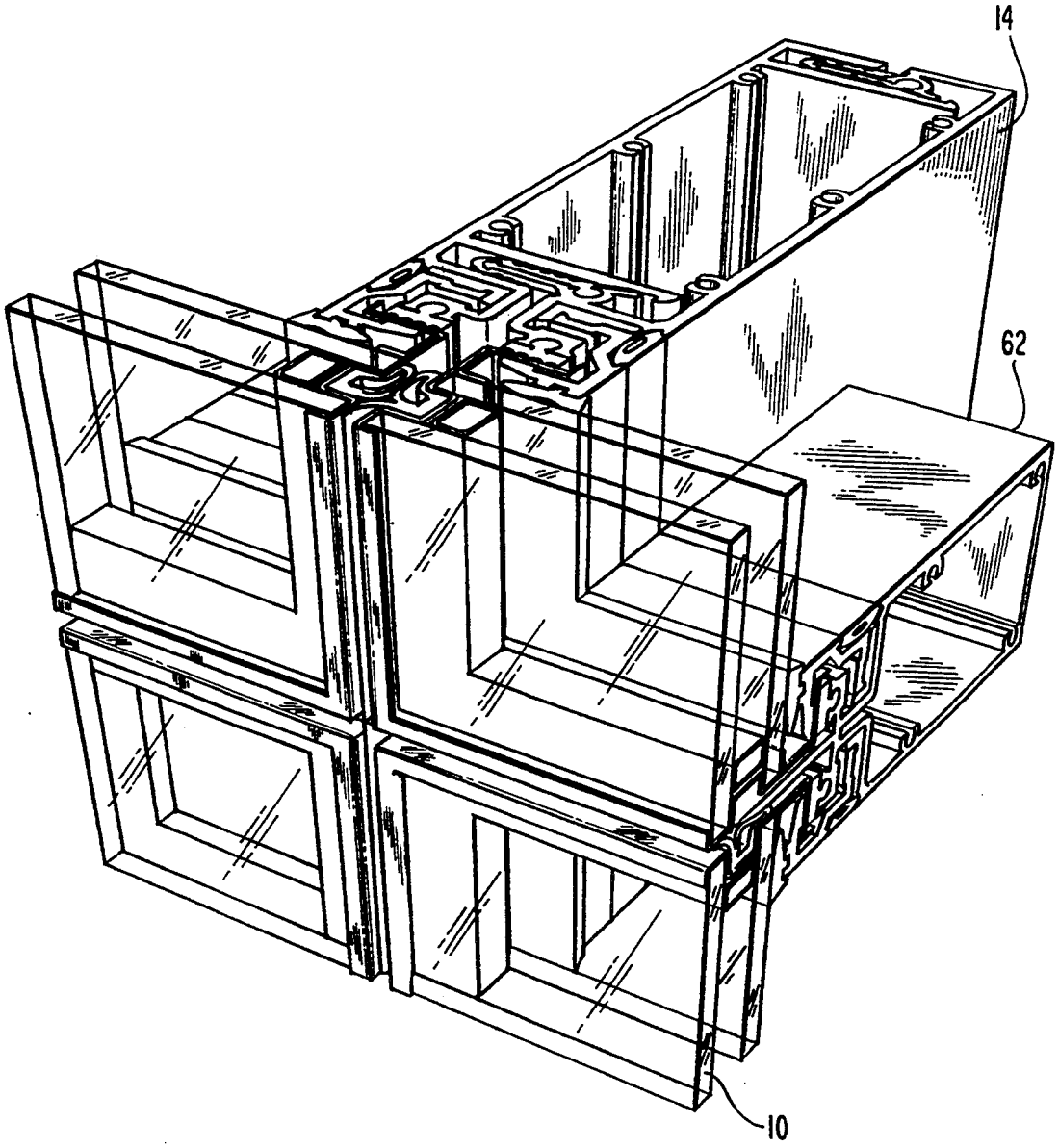
FIG. 3 is a perspective cross-sectional view of the first embodiment of the invention.

FIG. 3 is a pictorial view at an intersection of a vertical mullion 14 and a horizontal mullion 62. In this embodiment, the curtain wall system supports a dual arrangement of insulated glass panels 10.

Figure 4:
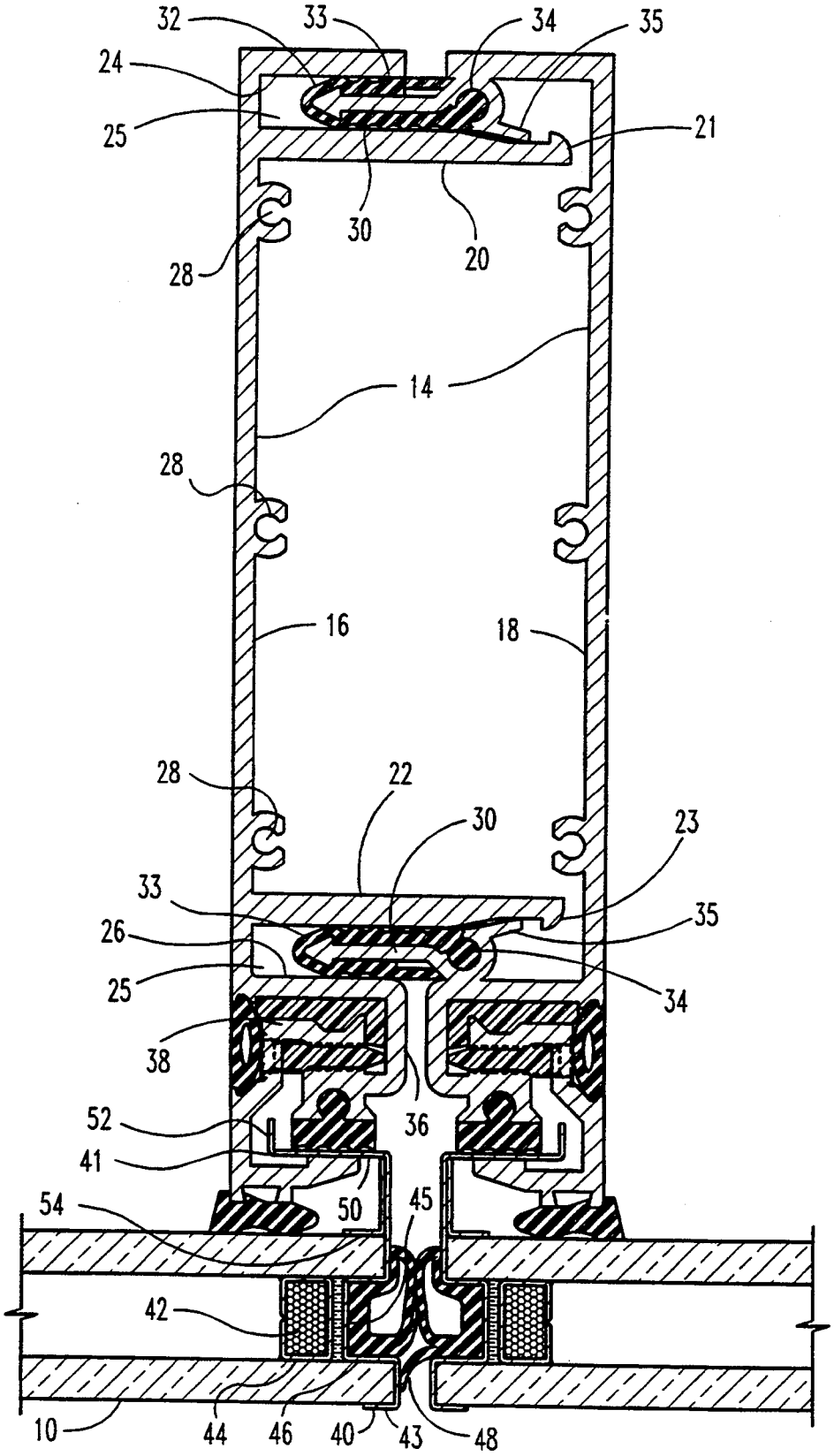
FIG. 4 is a horizontal cross-sectional view of a vertical mullion and attached retainer clip of the first embodiment of the present invention.

FIG. 4 illustrates a horizontal cross-sectional view through the vertical mullion 14 and insulated glass panels 10. The vertical mullion 14 is a two-piece mullion because it has an interlocking female half 16 and male half 18. The male half 18 is shaped symmetrically to the female half 16 except for different shaped flanges which extend from both the male half 18 and female half 16. A channel shaped chamber 36 forming a channel is formed at the front ends of the female half 16 and male half 18 which are closest to the exterior of the building.

The female half 16 includes female flanges 20 and 22 which extend at right angles from the female half 16 towards the male half 18. The female flanges 20 and 22 have respective barbed ends 21 and 23 to interlock with male flanges 30. The male flanges 30 extend at right angles from the male half 18. Interlocking fins 35 extend from one end of the male flanges 30 for engaging with the respective barbed ends 21 and 23 of the female half 16. A gasket pocket 34 is formed at the middle of the male flanges 30.

A cavity 25 is formed between female flange 20 and rear flange 24 and between female flange 22 and intermediate flange 26. Gasketted male flanges 30 of the male half 18 extend into the respective cavities 25. Each of the female half 16 and male half 18 has three extruded screw cavities 28 for attachment to horizontal mullions. The male flange 30 has an arrow head 32 at one end thereof securing a wrap-around weather gasket 33 covers and interlocks with the arrow head 32 and inside the gasket pocket 34.

A hook shaped edge cap 40 holds the insulated glass panels 10. The rear end flange 50 and webb 45 of the hook shaped cap 40 project towards the interior of the building for engaging with a clip assembly 38. A conventional desiccant spacer strip 42 and primary seal 44 are used to hold two panes of the insulated glass panels 10 together and prevent water from seeping between the panes. This type of conventional spacer strip is described in U.S. Pat. No. 4,841,700. The glass panes are further held together by the hook shaped edge cap 40 itself and by a secondary seal 46.

In this first embodiment, the hook shaped edge cap 40 has a front lip 43 to retain the insulated glass panel 10. The hook shaped edge cap 40 also has an intermediate webb portion 45 which has an intermediate depressed part to engage in the space between the insulated glass panels 10 adjacent to spacer strip 42. A self-adhesive back weather gasket 48 is positioned adjacent the intermediate depressed portion 45 of the hook shaped edge cap 40 and between the female half 16 and male half 18. The weather gasket 48 is provided with an interlocking fin and bulb arrangement for providing a weather-tight seal between the male and female halves of the vertical mullion 14. The hook shaped edge cap 40 has an inner parallel flange member 50 arranged parallel to the insulated glass panel 10. In this dual panel arrangement, the glass panel 10 is also mounted at the interior facing surface with a protrusion 54 extending from the intermediate portion 45 of the edge cap 40. The hook shaped edge cap 40 can be one piece or multiple pieces and can be bent or extruded. The hook shaped edge cap 40 can be formed of metal or plastic. It will be appreciated that different materials and shapes can be used for forming the cap.

Figure 5:
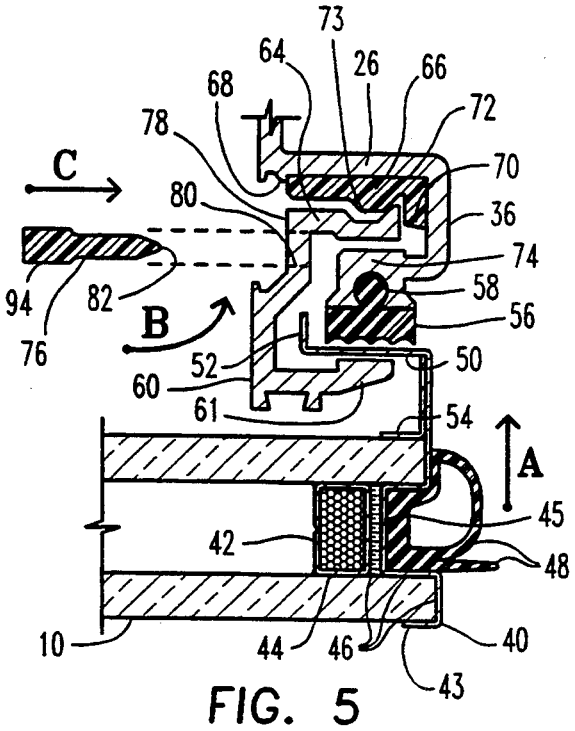
FIG. 5 is a horizontal cross-sectional view of half of a vertical mullion showing the installation of a retainer clip assembly and wedge.
Figure 6:
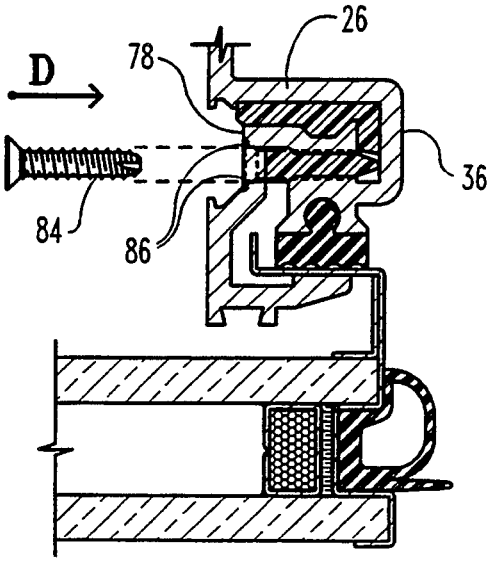
FIG. 6 is a horizontal cross-sectional view of half of a vertical mullion showing the installation of a retainer clip, wedge and screw.
Figure 7:
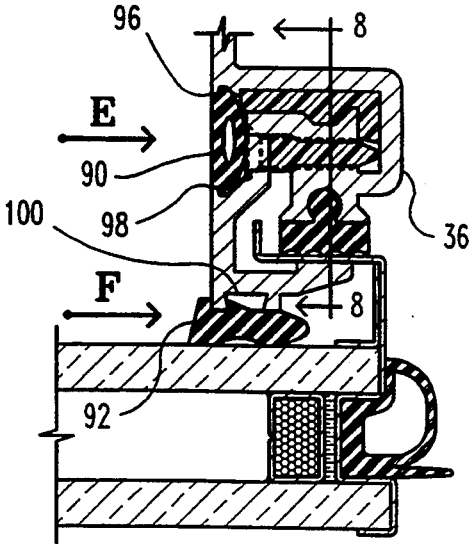
FIG. 7 is a horizontal cross-sectional view of half of a vertical mullion showing the installation of retainer clip assembly and gaskets.

FIGS. 5, 6, and 7 illustrate steps for installation of the insulated glass panel unit 10 and retainer clip assembly 38.

The installation begins with step "A" by installing the inner parallel flange 50 of the hook shaped edge cap 40 and urging it against a pre-installed weather pressure gasket 56. The weather pressure gasket 56, which includes a surface for receiving flange members 50 of edge cap 40, is secured into gasket pocket 58. Gasket pocket 58 forms the frontal portion of gasket holder 74 which forms the outer flange of the channel shaped chamber 36. Thereafter, in step "B" the insulated glass panel 10 is attached to the vertical mullion 14 with a retainer clip assembly 60. The retainer clip assembly 60 engages the channel shaped chamber 36 and the hook shaped edge cap 40. The retainer clip assembly 38 includes bracket channel retainer clip 60, positioned with outer flange 61 and inner flange 64.

Preferably, the retainer clip assembly 38 is attached to the channel shaped chamber 36 by means of a cushion and wedge which form a two part thermal break. An angle shaped cushion 66 is positioned between the interior side of intermediate flange 26 of channel shaped chamber 36. The angle shaped cushion 66 is retained by a projecting barb 68 located at end of the inner side of intermediate flange 26. The angle shaped cushion 66 has a short leg 70 and a long leg 72. An indentation for receiving the retainer clip 60 is located between the short leg 70 and the long leg 72. The long leg 72 has a projected guide tenon 73 with sloped positioning sides. The inner flange 64 is correspondingly grooved so as to engage with the long leg 72 and guide tenon 73.

As shown in FIG. 5, during installation, the inner flange 64 is moved adjacent the angle shaped cushion 66 and the outer flange 61 is moved adjacent the inner parallel flange member 50 of the hook shaped edge cap 40. The bracket channel retainer clip 60 is moved toward the channel shaped chamber 36 until inner flange 64 is adjacent short leg 70. A depression 78 is formed in the inner webb portion of the bracket channel retainer clip 60. The depression 78 has a plurality of slotted holes 80 for receiving a wedge 76 as shown in step "C". Preferably, the slotted holes are about 2 inches long and pre-drilled. The wedge 76 is preferably about 1.5 inches long and has a pointed front 82. The wedge 76 is manually driven in place and is held by its thickened base head 94. When the retainer clip 60 is installed, the parallel flange member 50 is sandwiched between the weather pressure gasket 56 and the bracket channel retainer clip 60 to form a tight fit.

During installation, the wedge 76 is forced between inner flange 64 and gasket holder 74. This wedging action forces the inner flange 64 to move in an inward direction so as to move away from one sidewall of the channel formed by channel-shaped member 36 and toward another sidewall thereof, and so as to rest on short leg 70 of the angled cushion 66. The projected guide tenon 73 of the long leg 72 with its sloped positioning sides guides and positions the grooved inner flange 64 of the retainer clip 60 in place. The bracket channel retainer clip 60 is also held in place by angle shaped cushion 66 interlocking with projecting barb 68. The inward wedging motion of retainer clip 60, forces outer flange 61 against the inner parallel flange member 50 of the hook shaped metal edge cap 40 so that inner parallel member 50 is forced against weather pressure gasket 56. After installation, the vertical mullion 14 is thermally broken from insulated glass panel 10 and hook shaped edge cap 40. In this installation the pressure applied by the wedge transmitted on the weather gasket can be constantly controlled, even at the extreme suction stress which results from negative wind pressure.

As shown in FIG. 6, after the retainer clip assembly 38 is installed, static equilibrium is equally applied by pressure weather gasket to the wedge 76 for holding it in place. An optional second means of attachment can be added or in an alternate embodiment could be used to replace wedge 76. In the second means of attachment as shown in step "D", screws 84 penetrate the depressed inner webb part 78 of retainer clip 60. Preferably the screws 84 are self tapping screws or sheet metal screws and the like. The screws are inserted through predrilled holes 86 are aligned with wedge 76 and its accommodating slotted holes 80.

FIG. 7 illustrates a cover gasket 90 which is placed over the visible assembled pieces of the retainer clip assembly 38 in step "E". Cover gasket 90 is held by gasket barb 96 to vertical mullion 14 and by gasket barb 98 to bracket channel retainer clip 60. A wedge gasket 92 is inserted between the bracket channel retainer clip 60 and the glass panel 10 to fill the gap between the clip and the interior face of the glass panel 10 in step "F". The wedge gasket 92 has a protrusion for engaging an indentation 100 of outer flange 61.

Figure 8:
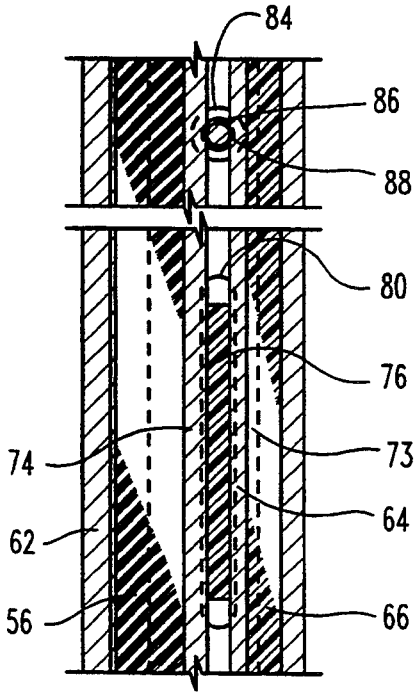
FIG. 8 is a vertical cross-sectional view at the retainer clip assembly and screw.

FIG. 8 is a vertical cross-sectional view after installation procedures of the retainer clip assembly 38 shown in FIG. 7. As shown in the upper portion of FIG. 8, the screw thread has thread engagement 88 at two opposite sides of the cavity for locking the retainer clip 60 in place.

Figure 9:
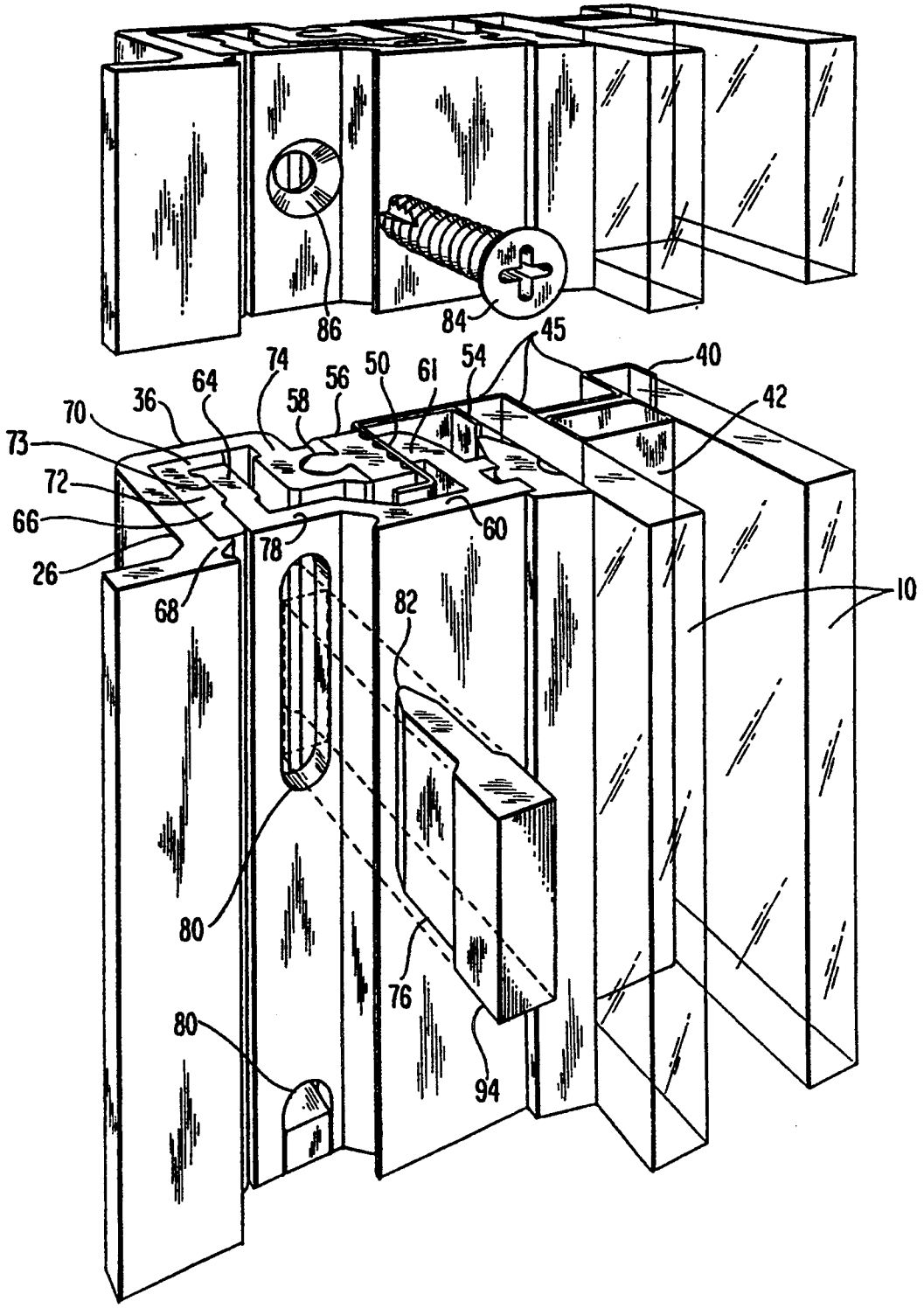
FIG. 9 is a perspective cross-sectional view of the preferred embodiment of the invention.

FIG. 9 is a perspective view of the retainer clip assembly 38, installed in the vertical mullion 14. In this embodiment, the wedge 76 is inserted with a straight-in wedging action through slotted hole 80 and locks bracket channel retainer clip 60 in place. Screw 84 is inserted into predrilled hole 86.

Figure 10:
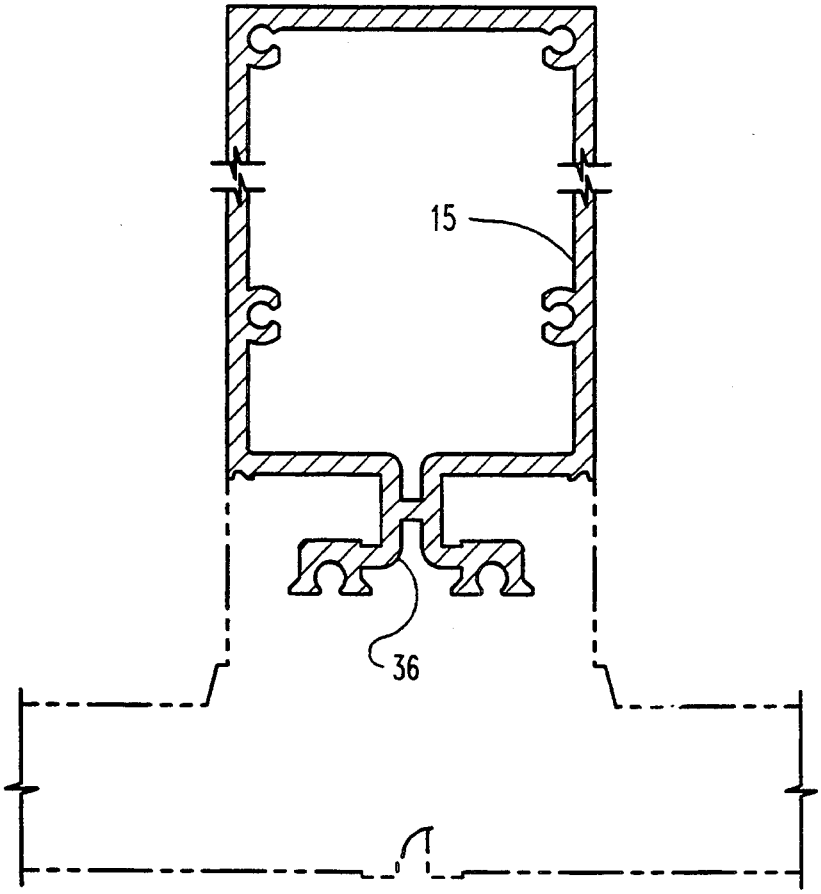
FIG. 10 is a horizontal cross sectional view of a one piece vertical mullion to be used in a second embodiment of the present invention.

FIG. 10 is a horizontal cross sectional view of a vertical intermediate mullion 15 used in a second embodiment of the presentation. The vertical intermediate mullion 15 can be deep or shallow. The vertical intermediate mullion 15 can be used in place of the female half 16 and male half 18 interlocking vertical mullion 14 which are shown in FIG. 4. The vertical intermediate mullion 15 differs from vertical mullion 14 in that it is formed of a one piece construction. The vertical intermediate mullion 15 includes the channel shaped chambers 36.

Figure 11:
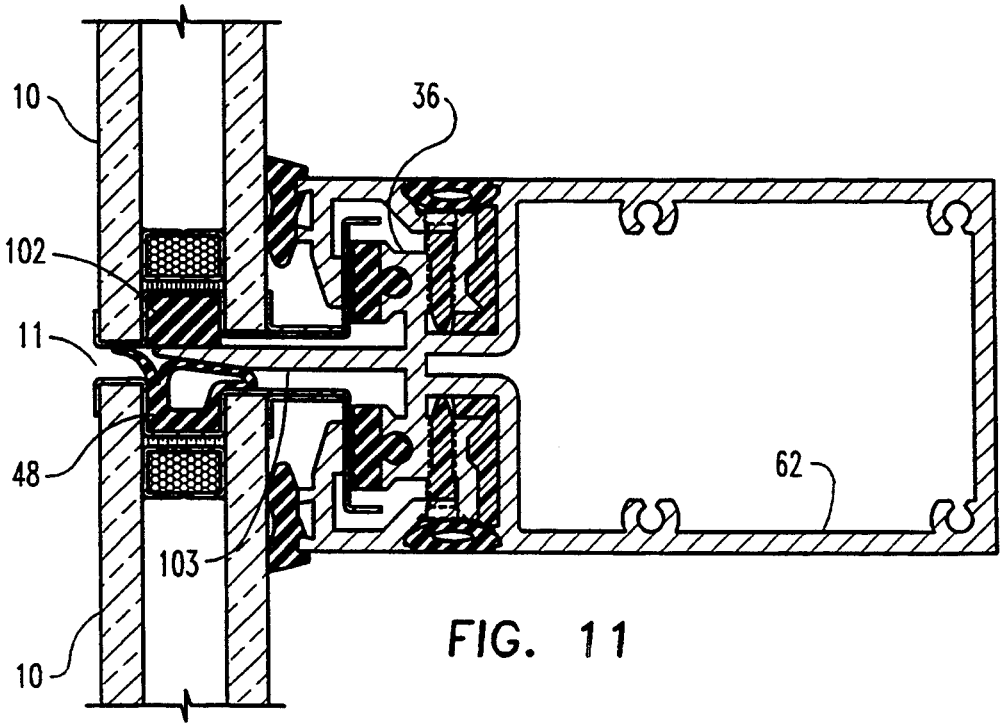
FIG. 11 is a vertical cross sectional view of a horizontal mullion of the present invention.

FIG. 11 is horizontal cross sectional view of a horizontal mullion 62, which has a one piece construction. The horizontal mullion 62 has the same channel shaped chamber 36 as the vertical mullion 14 shown in FIG. 4 for accommodating the retainer clip assembly 38. Preferably, the insulated glass panels 10 have a butt-joint 11 center line aligned with the center of the horizontal mullion 62. Weather gasket 48 is installed at the top edge of lower insulated glass panel 10. Gasket 48 is positioned between the insulated glass panels 10 adjacent a center flange shelf 103 extending horizontally outward from the horizontal mullion 62. The gravity load of the upper glass panel 10 is supported by the flange shelf 103. The bottom edge of upper glass panel 10 has a continuous glass setting block spacer solid gasket 102.

Figure 12:
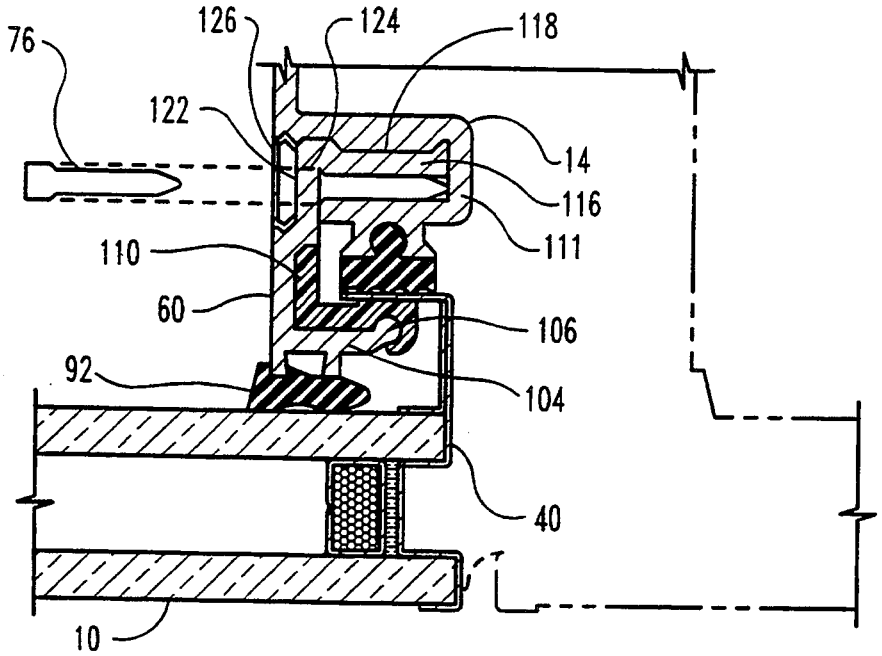
FIG. 12 is a horizontal cross-sectional view of half of a vertical mullion in a third embodiment of the present invention.

FIG. 12 is a horizontal cross section of the vertical mullion 14 of a third embodiment of the present invention in which outer flange 61, shown in FIG. 5, is replaced with a bulb shaped outer flange 104. The outer flange 104 has a bulb shaped end 106. A thermal break cushion 110 interlocks with bulb shaped end 106. The thermal break cushion 110 can be manufactured, installed or snapped in, as either continuous or small length cut pieces of about 2 inches. After installation of the thermal break cushion 110, vertical mullion 14 is thermally broken from the hook shaped end cap 40. The retainer clip 60 is also thermally broken from the insulated glass panel 10 by a wedge gasket 92. The retainer clip 60 directly engages the inner side of the channel shaped chamber 111. In this embodiment, inner flange 116 of the retainer clip 60 has a groove to engage with guide tenon 118 with its sloped positioning sides. Wedge 76 penetrates a webb depressed inner webb part 122 of the retainer clip 60 through slotted holes 124. Screws as described above can be used in place of wedge 76. A snap cover 126 is used to cover the wedge 76 or screws. The snap cover 126 preferably can be formed of extruded metal.

Figure 13:
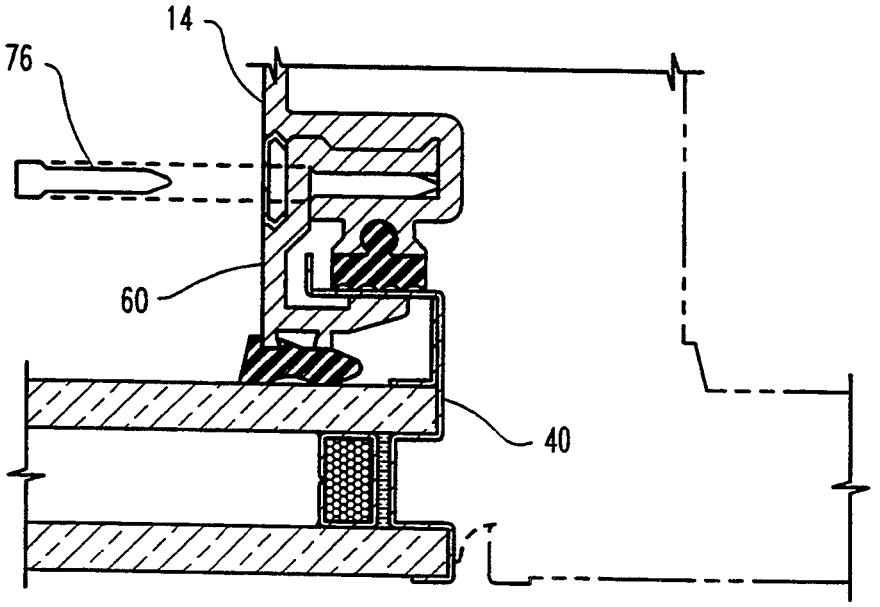
FIG. 13 is a horizontal cross-sectional view of half of a vertical mullion in a fourth embodiment of the present invention.

FIG. 13 illustrates a horizontal cross section of a vertical mullion 14 in which the retainer clip 60 directly engages the vertical mullion 14 without a thermal break in a fourth embodiment of the present invention. Preferably, this fourth embodiment is used in a curtainwall for dividing a closed atrium and adjacent office space of the interior of the building in which the temperature at the two sides of the curtainwall is controlled. Accordingly, the curtainwall does not need a thermal break. The manufacturing expenses, as well as materials and labor, of the curtainwall can be reduced by not providing the thermal break. In the indoor conditions, anticipated lateral windloads on glass panels are not expected, and, accordingly, the hook shaped edge cap 40 can be without the glass retainer lip 43 shown in FIG. 5.

Figure 14:
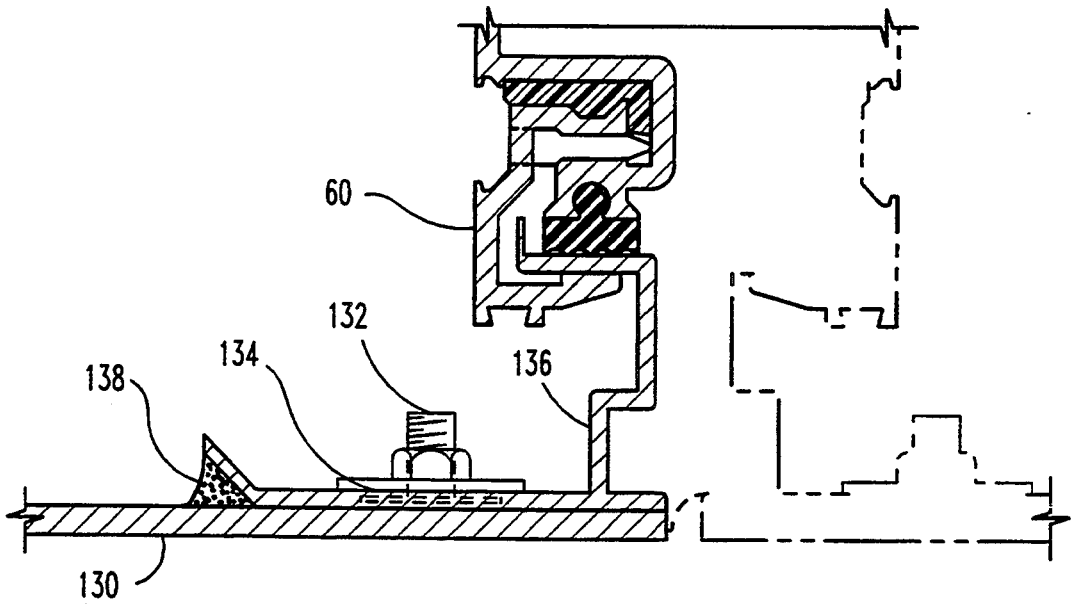
FIG. 14 is a horizontal cross-sectional view of half of a vertical mullion with a back-attached facing panel in a fifth embodiment of the present invention.

FIG. 14 illustrates a back attached face panel 130 instead of the insulated glass panel shown in FIG. 4 in a fifth embodiment of the invention. Preferably, the face panel 130 is thick gauge aluminum of about 0.125 to 0.188 inch. A hook shaped edge cap 136 attaches to the face panel. The hook shaped edge cap has over-sized holes 134 for receiving welded studs 132. The face panel 130 is weather sealed with caulking 138 between the face panel 130 and the hook shaped edge cap 136 and around the welded studs 132. The back attached face panel 130 can be single or multiple, thin or thick, glass, metal, granite/marble or plastic of monolithic or composite panels. The attachment method can be adjusted to suit the panel type, thickness and construction.

Figure 15:
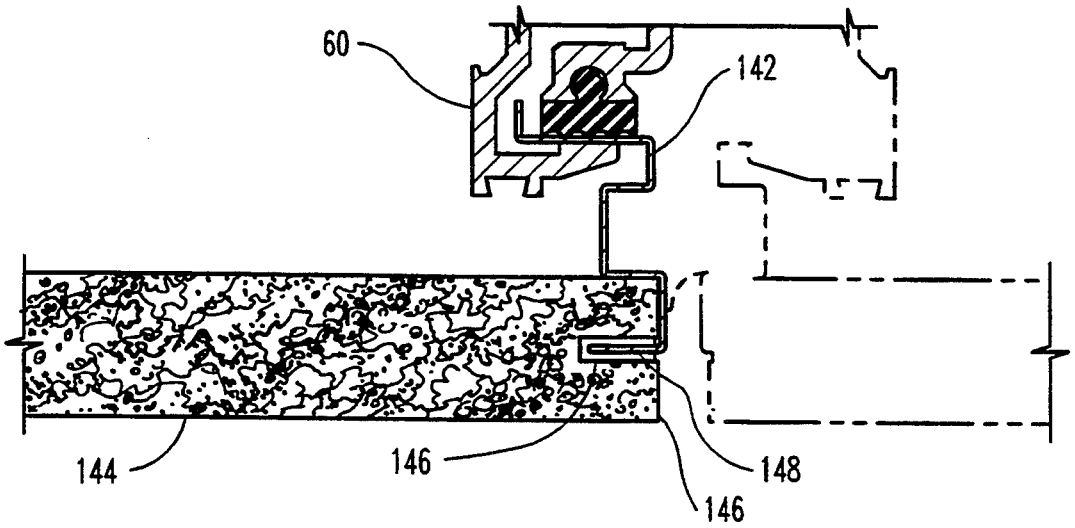
FIG. 15 is a horizontal cross-sectional view of half of a vertical mullion with an edge-attached facing panel in a sixth embodiment of the present invention.

As shown on FIG. 15, a hook shaped edge cap 142 can be edge attached in a sixth embodiment of the present invention. The panel 144 is fabricated with a hook shaped edge 142 which is integrated with the panel 144. The hook shaped edge cap 142 includes a flange 148 for engaging a groove 146 in the panel edge. In this embodiment, the panel 144 is a granite or marble panel, the panel is preferably about 0.75 inch thick. Preferably, the flange 148 and groove 146 can be continuously formed. In the alternative, the flange 148 can be formed of plurality of small length pieces or formed in small length pieces of at least two pieces per side depending on the material to be supported. The facing panel thickness and attachment details depend on the structural properties and the total area of the panel 144 which must be supported by the hook shaped edge cap 142.

In alternate embodiments of the present invention, the panels 10, 12, 130 and 144 are formed of single, multiple or composite materials and construction. The hook shaped edge cap is shaped to accommodate the differently constructed panels. For example, in a dual panel system the edge cap can be formed to accommodate an indentation or a recess of one of the panels from the other panel.

The present invention has the advantage of providing a stopless curtainwall system for attaching a building panel to vertical and horizontal preassembled units with ladder shape mullions which can be easily installed from the interior of the building. The case of a retainer clip assembly in combination with a hook shaped cap for holding the panel eliminates the need for structural sealant while providing a stopless butt-joint. The hook shaped cap can have various shapes to hold different types of panels and different panel thickness, material, construction type and arrangements. Further, the curtainwall system includes a cushion and wedge arrangement for providing a thermal break.

While the invention has been described with reference to the preferred embodiment thereof, it will be appreciated by those of ordinary skill in the art that modifications can be made to the structure and elements of the invention without departing from the spirit and scope of the invention as a whole.

I claim:

1. A curtainwall system that secures at least one panel on a building comprising:

at least one elongate mullion having a panel securing portion extending longitudinally along the mullion and a channel extending longitudinally along the mullion adjacent the panel securing portion, said channel having a first sidewall adjacent the panel securing portion and a second sidewall opposed to and spaced from the first sidewall;

a panel engaging member having a first portion that engages the panel and a second portion, spaced from the first portion, that engages the panel securing portion;

a retaining member that holds the second portion of the panel engaging member on the panel securing portion, the retaining member having a first leg received in the channel, a second leg overlying the second portion of the panel engaging member and urging said second portion of the panel engaging member into engagement with said panel securing portion, and an intermediate portion extending between the first leg and the second leg; and a wedge inserted in a direction substantially parallel to said panel between said retaining member and said mullion, insertion of the wedge between the retaining member and the mullion causing said retaining member to move in a direction substantially perpendicular to the panel to apply compressive force on the second portion of the panel engaging member between the retaining member and the mullion.

2. The curtainwall system of claim 1 wherein said panel includes a front and rear face and said first portion of said panel engaging member mounts on said rear face.

3. The system of claim 1 wherein said panel engaging member engages an edge of said panel.

4. The curtainwall system of claim 1, further comprising: at least one aperture in the intermediate portion of the retaining member, said aperture being positioned adjacent the first leg and the first sidewall, wherein the wedge is inserted through the aperture, insertion of the wedge causing the first leg to move away from the first sidewall and toward the second sidewall, whereby the second leg clamps the panel engaging member against the panel securing portion.

5. The curtainwall system of claim 4, further comprising a threaded screw inserted through the retaining member and between the retaining member and the mullion.

6. The curtainwall system of claim 4 wherein said at least one mullion is a split mullion having interlocking male and female sections.

7. The curtainwall system of claim 4 and further comprising a preformed gasket disposed between the retaining member and the panel.

8. The curtainwall system of claim 4 and further comprising a first preformed gasket disposed between the panel securing portion of the mullion and the second portion of the panel engaging member and a second preformed gasket disposed between the retaining member and the panel.

9. The curtainwall system of claim 8, wherein the panel securing portion includes means retaining the first gasket and wherein the retaining member includes means retaining the second gasket.

10. The curtainwall system of claim 4, further comprising a cushion located between the first leg of the retaining member and the second sidewall of the channel, wherein the cushion is disposed along said second sidewall and the first leg of the retaining member includes an interlocking portion interlocking with the cushion.

11. The curtainwall system of claim 1, wherein the panel has an edge and said edge includes a groove and wherein the first portion of the panel engaging member includes a groove engaging portion for holding the panel.

12. The curtainwall system of claim 11, wherein the panel comprises a double-glazed panel having first and second glazing sheets and a separator therebetween, the groove being formed between the first and second sheets and wherein the groove engaging portion of the panel engaging member is disposed in the groove, wherein the first portion of the panel engaging member spans the edge of said double-gazed panel.

13. The curtainwall system of claim 11, wherein the first portion of the panel engaging member includes retaining structure that retains a preformed gasket along said edge of the panel and further comprising a preformed gasket retained by the retaining structure.

14. The curtainwall system of claim 1, wherein the panel engaging member comprises an elongate portion disposed between the first portion and the second portion, said elongate portion extending in a direction transverse to a plane of the panel.

15. The curtainwall system of claim 1, wherein the panel securing portion of the mullion includes a surface receiving the second portion of the panel engaging member and the channel faces in a direction transverse to a direction said surface faces.

16. The curtainwall system of claim 1, wherein said at least one mullion is horizontally disposed and wherein said mullion includes an outwardly extending flange that supports the gravity load of said panel.

17. The curtainwall system of claim 1, wherein the mullion includes an outwardly disposed sidewall and the retaining member is shaped so that the intermediate portion of the retaining member is substantially flush with said sidewall of the mullion.

18. The curtainwall system as in claim 1 and further comprising a cover member that covers at least a part of the channel.

19. The curtainwall system of claim 1, wherein the second leg of the retaining member includes a cushion engaging the second portion of the panel engaging member.

20. The curtainwall system of claim 19 wherein said second leg of said retaining member includes a bulb shaped end and said cushion interlocks with said bulb shaped end, further wherein said cushion is located between said retaining member and said panel engaging member.

21. The curtainwall system of claim 1, wherein the first portion of the panel engaging member comprises a groove that receives an edge of the panel.

22. The curtainwall system of claim 21, wherein the groove includes a portion extending over a front face of the panel.

23. A curtainwall system as in claim 1, wherein said at least one mullion is vertically placed and further comprising at least one horizontally placed additional mullion, said additional mullion having a panel securing portion extending longitudinally along the additional mullion and a flange extending outwardly from a front face of the additional mullion for supporting the gravity load of the panel, wherein the additional mullion includes a channel extending longitudinally along said additional mullion, said channel having a first sidewall adjacent the panel securing portion and a second sidewall opposed to and spaced from the first sidewall, the curtainwall system further comprising:

a second panel engaging member having a first portion that engages the panel and a second portion spaced from the first portion, that engages the panel securing portion of the additional mullion, and a second retaining member that holds the second portion of the second panel engaging member on the panel securing portion of the additional mullion, the second retaining member having a first leg received in the channel of the additional mullion, a second leg overlying the second portion of the second panel engaging member and urging said second portion of the second panel engaging member into engagement with said panel securing portion of the additional mullion, and an intermediate portion extending between the first leg and the second leg of the second retaining member.

24. A curtainwall system for securing at least one panel on a building comprising:

at least one mullion having an outwardly facing end wall and a panel securing portion on the end wall;

a panel engaging member having a first end portion engaging said at least one panel, a second end portion engaging said panel securing portion of the mullion and a rearwardly extending intermediate portion connecting the first end portion with the second end portion;

a retaining member having a transversely extending leg engaging the second end portion of the panel engaging member; and a wedge inserted through the retaining member in a direction substantially parallel to said transversely extending leg, insertion of said wedge causing said leg to impart a compressive loading on the second end portion of the panel engaging member to secure the panel engaging member on the mullion as the wedge is inserted through the retaining member.

25. The curtainwall system of claim 2 further comprising:

a cushion located adjacent said retaining member, wherein said keeper element in combination with said cushion forms a thermal break while locking said retaining member to said at least one mullion.

26. A method of attaching at least one building panel to at least one mullion mounted in a building in order to form a curtainwall between the interior and the exterior of the building, said method comprising the steps of:

attaching a panel engaging member to an edge of said panel, said panel engaging member including an inwardly facing leg section having an end portion placed against the mullion;

positioning said end portion of the panel engaging member against the mullion;

from a location in the interior of the building, positioning a retaining member over said end portion of said panel engaging member and into engagement with a portion of said mullion; and from a location in the interior of the building affixing said retaining member to said mullion;

wherein the step of affixing said retaining member to said mullion includes passing a wedge between said retaining member and said mullion to at least partially fill a space between said retaining member and said mullion and to move said retaining member in a direction substantially perpendicular to said panel.

27. The method of claim 26, wherein the step of affixing the retaining member to the mullion includes moving the retaining member in a direction transverse to the panel to apply compressive loading to the end portion of the panel engaging member, whereby the panel engaging member is secured onto the mullion.

28. The method of claim 26 wherein said passing step includes passing the wedge through an aperture in said retaining member.

29. The method of claim 26 affixing said retaining member to said at least one mullion further comprising the step of passing a screw through an aperture in said retaining member and into secured engagement with said mullion.

30. The method of claim 29 wherein the screw passing step includes passing the screw between a portion of the retaining member and the mullion to effect clamping of the panel engaging member onto the mullion.

31. The method of claim 26, further comprising the step of positioning a preformed gasketing material between the mullion and the end portion of the panel engaging member.

32. The method of claim 26, wherein the passing step includes inserting the wedge into said space in a direction substantially perpendicular to the direction of movement of said retaining member.

* * * * *